United States Patent [19]

Cattaneo

[11] Patent Number: 4,750,259

[45] Date of Patent: Jun. 14, 1988

[54] METHOD OF MAKING ARMATURE GROUP FOR MOSAIC PRINTING HEAD

[75] Inventor: Sergio Cattaneo, Rho, Italy

[73] Assignee: Honeywell Bull Italia S.p.A., Milan, Italy

[21] Appl. No.: 911,586

[22] Filed: Sep. 24, 1986

Related U.S. Application Data

[60] Division of Ser. No. 841,066, Mar. 18, 1986, Pat. No. 4,648,730, which is a continuation of Ser. No. 664,134, Oct. 24, 1984, abandoned.

[30] Foreign Application Priority Data

Nov. 23, 1983 [IT] Italy ..... 23833 A/83

[51] Int. Cl.[4] ..... H01F 7/06; H01R 43/00

[52] U.S. Cl. ..... 29/602 R; 29/418; 29/445; 29/622; 29/884

[58] Field of Search ..... 29/418, 662, 445, 884, 29/602 R; 400/124; 101/93.05

[56] References Cited

U.S. PATENT DOCUMENTS

| | | | |
|---|---|---|---|
| 3,609,861 | 10/1971 | Allison | 29/418 X |
| 3,828,908 | 8/1974 | Schneider | 400/124 |
| 3,859,712 | 1/1975 | Tramposch | 29/418 |
| 3,921,277 | 11/1975 | Tramposch | 29/418 |
| 4,204,778 | 5/1980 | Miyazawa et al. | 400/124 |
| 4,214,836 | 7/1980 | Wang | 400/124 |
| 4,228,577 | 10/1980 | Suzuki et al. | 29/418 |
| 4,252,449 | 2/1981 | Miyazawa et al. | 101/93.05 X |
| 4,423,969 | 1/1984 | Kobryn | 101/93.05 X |
| 4,433,926 | 2/1984 | Isobe et al. | 101/93.05 X |
| 4,439,913 | 4/1984 | Coquillart | 29/418 X |
| 4,618,276 | 10/1986 | Blomquist et al. | 29/602 R |

FOREIGN PATENT DOCUMENTS

| | | |
|---|---|---|
| 0081809 | 12/1982 | European Pat. Off. . |
| 2059353 | 4/1981 | United Kingdom . |

*Primary Examiner*—Charlie T. Moon

*Attorney, Agent, or Firm*—Faith F. Driscoll; John S. Solakian

[57] ABSTRACT

An armature group for mosaic printing head has a plurality of armatures wherein each armature which is part of an actuation electromagnet associated with one of a plurality of printing needles, is fixed to an elastic arm of a spring steel spider having as many arms as there are armatures. The spider, besides performing an armature positioning function allows the armature group to be handled as a unitary element which is easy to assemble. The thrust arm of each armature further has a double bend so that the plane between such arm and the corresponding needle head is perpendicular to the axis of the needle and passes through the fulcrum of the armature. This minimizes the buckling force which the needle has to undergo during the actuation phase. The construction of the armature group can be accomplished by a completely automated manufacturing process.

1 Claim, 3 Drawing Sheets

METHOD OF MAKING ARMATURE GROUP FOR MOSAIC PRINTING HEAD

This application is a division of application Ser. No. 841,066, filed Mar. 18, 1986, now U.S. Pat. No. 4,648,730, which application is a continuation of application Ser. No. 06/664,134, filed Oct. 24, 1984, now abandoned.

BACKGROUND OF THE INVENTION

1. Field of Use

The present invention relates to an armature group for a mosaic printing head and related manufacturing method.

2. Prior Art

A mosaic printing head comprises a plurality of printing needles and a corresponding plurality of actuating electromagnets radially arranged on a bearing ring. Each electromagnet is provided with a movable armature having one end extending beyond the magnetic circuit of the electromagnet which acts as thrust arm for one of the printing needles. The contact points between each of the movable armatures and the related needle heads are uniformly arranged along a circumference located on a plane parallel to the electromagnet bearing ring. A distribution of the needle printing ends according to one or more parallel columns is obtained by having the needles elastically bent so as to assume a gradual bending controlled and supported by suitable guides.

A retainer for the several electromagnets armatures is associated with the electromagnetic group which comprises the plurality of electromagnets. Such armature retainer, besides enabling correct armature movement and defining the width of the air gap of the several electromagnets in rest position, further acts as damper when an electromagnet armature changes from an actuated state to a release state. Examples of such heads are disclosed in U.S. Pat. Nos. 4,260,270 and 4,367,962.

Low cost and high reliability are particularly important for a mosaic printing head. The manual assembling time is a factor which greatly affects the cost of a mosaic printing head. Several head manufacturers try to reduce to a minimum, the number of parts of a head which are manually assembled so as to cut the assembling time, such parts being produced by automated processes. U.S. Pat. No. 4,433,927 which is assigned to the applicant discloses, for example, an electromagnetic group for a mosaic printing head and an automated process for producing such group as a unitary piece.

At present, the most critical phase in the head assembly is that of separately mounting the armatures in suitable positions on the magnetic circuits. In fact, besides the relatively long time required by such operation, it is difficult to subsequently mount the armature retainer without affecting the positions of these armatures, particularly in the case of heads having a large number of armatures, such as 14 or 18 needle heads.

U.S. Pat. No. 4,140,406 suggests that the retainer include a series of projections for sustaining and guiding each armature. During assembling, each of the armatures is inserted between such projections and held in position therein. Subsequently, the retainer, together with the armatures, can be assembled with the electromagnet group.

Such solution, besides involving a retainer which is complex to construct, still requires the manual insertion of armatures into the appropriate retainer housings.

Further, the projections can apply variable amounts of friction to the armatures during the printing head operation, causing the non-uniform behavior of several printing elements.

The reliability of the mosaic heads largely depends upon the breaks that a printing needle may undergo due to the stresses applied during the actuation phase by the corresponding armature. The generalized use of a flat armature does not allow for correct contact between the needle head and the armature. Thus, during the actuation phase, an undesired moment is generated on the guides and the needle head. Due to such moment, the needle may undergo a buckling force which can reach the breakage limit.

In order to overcome such disadvantage, previously mentioned U.S. Pat. No. 4,140,406 suggests bending the end of the armature protruding outside the magnetic circuit of the electromagnet, in order that such end be perpendicular to the needle axis in correspondence with the contact point. However, such solution does not completely eliminate the undesired moment on the guides and on the needle head so that from this point of view, the head has little reliability.

A first object of the present invention is to reduce the head cost by cutting to a minimum, the manual assembly time of the armature on the magnetic circuits by simplifying the structure of such armature retainer.

A further object of the present invention is to increase the head reliability by almost completely eliminating the undesired moment on the guides and on the needle head during the actuation phase.

SUMMARY OF THE INVENTION

The above objects are obtained by the manufacturing process of the present invention. According to a first feature of the invention, each of the armatures, located in correct position relative to each other, is fixed to an elastic arm of a spring spider having as many radial arms as there are armatures. The restraint between the spider arm and the armature can only move in a direction which is perpendicular to its plane. In this way, the set of spider-armatures constitutes a unitary element which is easy to assemble. Further, the function of armature guide provided in the art for the armature retainer, can be performed by the spider arms, thus obtaining a simplification in construction for the armature retainer, as well as totally eliminating the friction between retainer and armatures during operation.

According to a further aspect of the invention, the ends of the armature, which protrude outside the electromagnet magnetic circuit, have a double bend so that the part of such ends contacting the needle head be on a plane perpendicular to the needle axis which passes through the fulcrum of the armature. In this way, the undesired moment exerted on the guides and the needle head during the actuation phase is almost completely eliminated.

According to a further feature of the invention, the spider-armature set is constructed by an automated process which avoids the individual handling of several armatures by an assembler.

These and other features will appear clearer from the following description and the accompanying drawings.

DESCRIPTION OF THE PREFERRED EMBODIMENT

Figure 1:
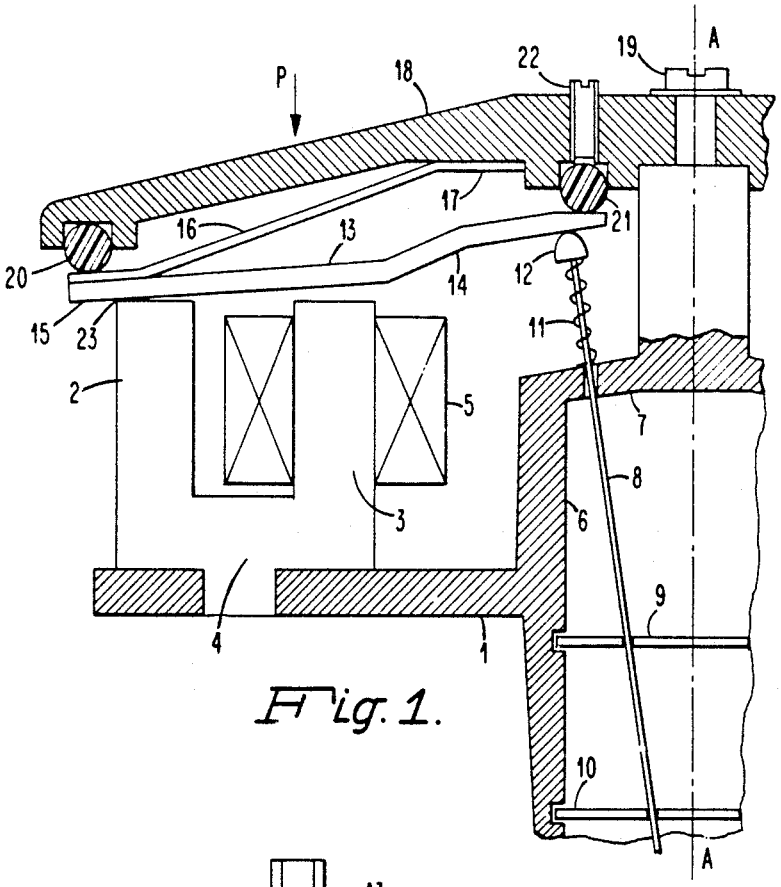
FIG. 1 is a partial section view of a needle printing head comprising the armature group of the present invention.

With reference to FIG. 1, it is seen that the printing head comprises a bearing support element 1 for the electromagnets and the needles. The bearing element 1 is a circular ring shaped plate with axis A—A. A desired number n of magnetic cores are mounted on the ring and radially arranged around axis A—A, each of such cores consisting of two columns 2 and 3 and a yoke 4.

In FIG. 1, only one core is shown. An electrical winding 5 is arranged around a column of the core, for instance, column 3. The bearing support element 1 has a central hollow bushing 6 which is pierced on a top 7 to enable the passage of needles, such as needle 8. Inside bushing 6 there are pierced diaphragms, such as diaphragms 9 and 10, arranged for guiding needle 8. A coil spring 11 wound around needle 8 moves between the upper side of the top 7 of bushing 6 and needle head 12.

A movable armature 13 is positioned on the top of columns 2 and 3 and extends radially towards axis A—A. It has an arm 14 which presses against head 12 of printing needle 8. Each armature, such as 13, is restrained, for instance, by welding at an end 15 to an elastic arm 16 which protrudes radially from an annular body 17 and has a suitable double bend.

Figure 2:
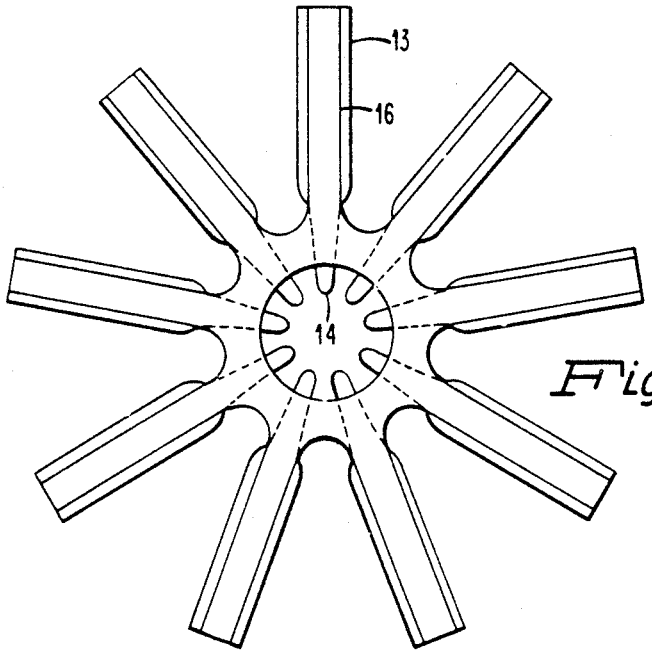
FIG. 2 is a top view showing the armature group of the present invention.

FIG. 2 is a top view showing in the direction of arrow P of FIG. 1, the set consisting of annular body 17, a number of related arms, such as arm 16, and a number of armatures, such as armature 13. In the particular case of FIG. 2, the set is referred to as a nine needle printing head.

The annular body 17 and each of the related arms 16 are embodied in spring steel of suitable thickness (for instance 0.3 mm) which assures the radial positioning of each of the armatures 13. As seen from FIG. 1, a ring shaped armature retainer 18 is suitably fixed to bushing 6 by a screw 19. Retainer 18 has a central cylindrical portion designed for insertion into the central opening of annular body 17. It is further provided with two circular grooves for housing two resilient rings (O-RING) 20 and 21, respectively. The positioning of O-RING 21 in the groove in correspondence with several armatures, can be adjusted by means of screws, such as screw 22 of FIG. 1, which acts in concert with armature 13. In this way, O-RING 21, besides, providing a damping action after the release of the armatures, performs the function of defining the rest position of the several armatures; that is, within the air gap between the tops of columns, such as column 3 and each armature, such as armature 13. O-RING 20 acts on the ends of the armatures, such as end 15 through the elastic arms, such as arm 16.

With reference to FIG. 1, the O-RING 20 produces a moment on armature 13 which tends to rotate such armature about a fulcrum 23 moving it away from column 3. A similar effect is produced by the force exerted by spring 11 on armature 13 through head 12. It is to be noted that, in the disclosed embodiment, the stiff restraint present between armature 13 and elastic arm 16, produces a resisting moment on armature 13 which tends to offset the moments generated by O-RING 21 and spring 11. However, if such resisting moment is less than the sum of the moments generated by O-RING 20 and spring 11, no operational problems arise.

In FIG. 1, it is to be noted that arm 14 of armature 13 has a double bend, in order that the plane of contact of arm 14 with head 12 of needle 8 is perpendicular to the axis of needle 8 and contemporaneously passes through fulcrum 23 of armature 13 when the armature is in the rest position or, preferably, when it is in a position intermediate between the rest and actuated positions. Further, the end of arm 14 is suitably ground in order that the bearing plane of such end with O-RING 21 is perpendicular to axis A—A. The double bend of thrust arm 14 of each of the armatures, such as armature 13, minimizes the undesired moment on the needle head during the actuation phase.

Figure 3:
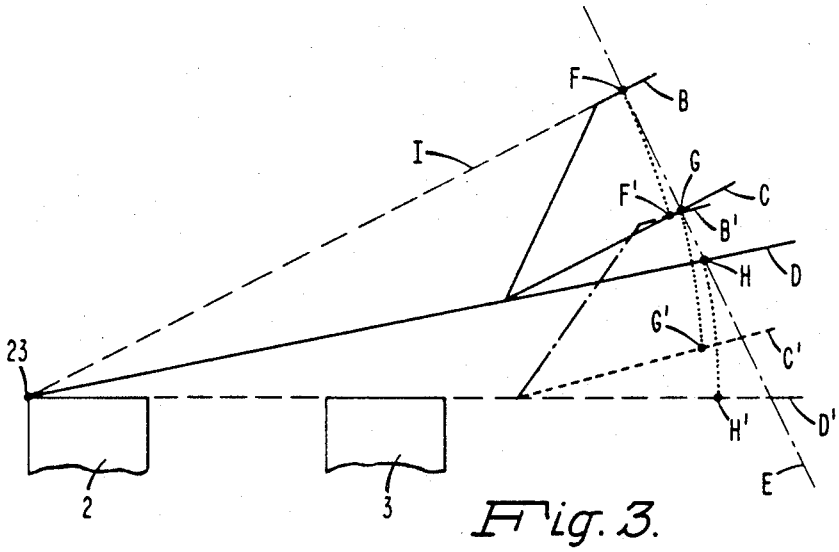
FIG. 3 outlines the minimization of undesired effects on the printing needle during the actuation phase obtained with the armature group of the present invention as compared with the armatures known in the art.

With reference to FIG. 3, the continuous lines B, C and D, respectively, schematically show at a rest position, the plane of contact of armature thrust arms with a double bend, such as that of the present invention, with only one bend, such as that of previously mentioned U.S. Pat. No. 4,120,406, and with no bend. The hatched lines B', C' and D', show the contact planes corresponding to lines B, C, and D, respectively, when the armatures due to energization, move about fulcrum 23 and lie on columns 2 and 3 of the magnetic circuit. The hatched line E indicates the needle axis.

At the end of the energization phase, the contact points F, G and H between the needle head and contact planes B, C and D, respectively, move to the corresponding points F', G' and H', of contact planes B', C' and D'. The distance between points F', G' and H' from the needle axis provides a measurement of the buckling, as well as of the corresponding undesired moment to which the needle is subjected by the friction between needle head and armature. Such buckling is minimized in the case where the contact plane of the thrust arm 14 is perpendicular to the needle axis and passes through fulcrum 23, as shown by hatched line I in FIG. 3.

Figure 4:
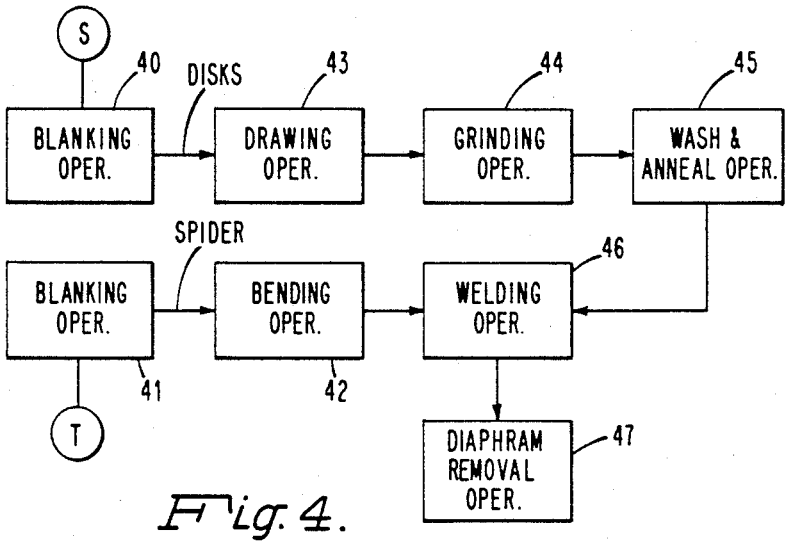
FIG. 4 shows in flow diagram form, the manufacturing process or method used for embodying the armature group according to the invention.
Figure 5:
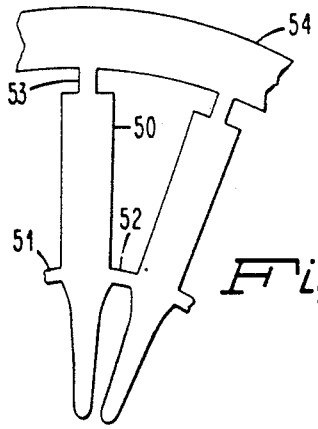
FIG. 5 is a partial view of the armature group of the present invention at the end of a phase of the manufacturing process of FIG. 4.

An armature group, such as the one disclosed and shown in FIG. 2, can be embodied by a completely automated manufacturing process. FIG. 4 shows such manufacturing process in flow diagram form. The raw materials are S sheets or bands of magnetic materials and spring steel sheets or bands T. The magnetic material plates S were previously blanked in order to obtain disks containing all the head armatures already in relatively the correct positions but joined one to the other by suitable diaphragms. This operation is indicated in block 40 of FIG. 4. The result of such operation is partially shown in FIG. 5 where each armature, such as armature 50 is joined to the adjacent armatures by means of diaphragms 51 and 52. A further diaphragm 53 joins armature 50 to a ring 54.

By an operation indicated in block 41 of FIG. 4, each steel plate T was also previously blanked in order to obtain a spring steel spider; that is, a plurality of elastic arms, such as arm 16 of FIG. 2 radially protruding from an annular body, such as body 17. By an operation indicated in block 42, each spider arm undergoes suitable bending in order to assume a shape similar to that of arm 16 of FIG. 1.

The armature disk obtained from blanking plate S, as indicated in block 40, undergoes the drawing operation of block 43 which shapes each of the armature thrust arms like the armature end 15 of FIG. 1. The end of the thrust arm of each of the armatures is ground as indicated in block 44 to ensure that the rest of the plane of contact of such ends with O-RING 21 of FIG. 1 is perpendicular to the printing head axis (i.e., axis A—A of FIG. 1) when the head has been assembled.

As indicated in block 45, the armature disk is passed through a washing and subsequent annealing phase to reestablish the original magnetic characteristics of the magnetic material. As indicated by block 46, the armature disk and the spring steel spider are passed through a resistance welding station where the spider is suitably positioned on the armature disk and, thereafter, the elastic arm ends of such spider are welded to the ends of the armatures just as the end 15 of armature 13 of FIG. 1. Finally, as indicated in block 47, the diaphragms, such as 51, 52 and 53 of FIG. 5, joining the armatures are removed so that they remain free from each other and joined only to the spider elastic arms. This operation can be performed by blanking or by grinding them with a disk guiding wheel or other means. The obtained group is ready to be assembled in a printing head. It is to noted that the operations indicated in blocks 40 through 47 of FIG. 4 are performed with manufacturing equipment known in the art.

Clearly, several modifications can be made to the disclosed armature group and to the related manufacturing method without departing from the scope of the present invention. For instance, the spider whose arms restrain the armatures can be embodied in alternate geometrical shapes, such as one where elastic radial arms project inwardly to a bearing annular body having a diameter longer than the diameter of the annular body of the present invention. It is clear that alternate geometrical shapes for the spider involve making corresponding modifications in the internal side of the armature retainer.

Figure 6A:
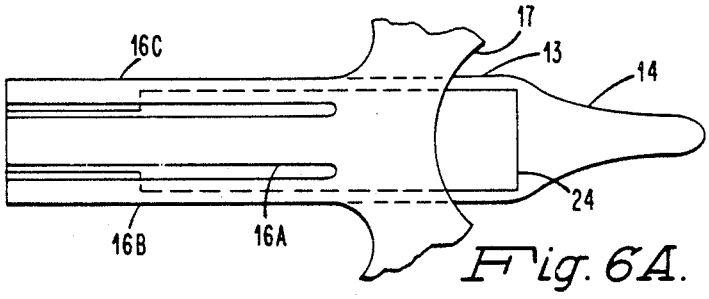
FIGS. 6A and 6B schematically show, according to different positions, a variation of the armature group of the present invention in the case where a counter armature is coupled to each armature.
Figure 6B:
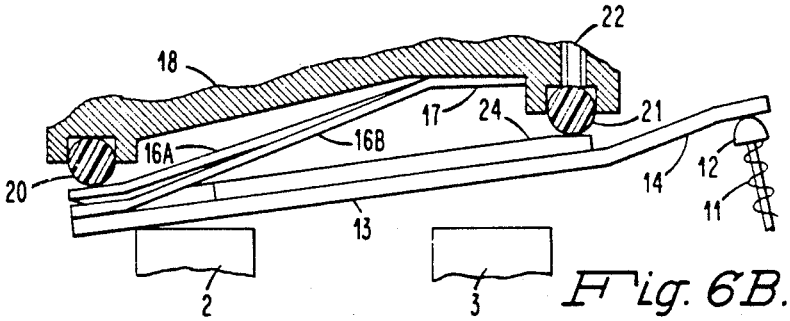

Further modifications can be made to the spider arms in the case where the electromagnetic group of the printing head have particular structures. For instance, the Italian patent application No. 23004 A/83, filed on Sept. 27, 1983, by the same applicant which corresponds to U.S. Ser. No. 650,472, filed on Sept. 14, 1984, discloses an electromagnetic group where movement of each armature to its rest position is initially damped by a counter armature in non-magnetic material, due to the air cushion interposed between the counter armature and armature. FIGS. 6A and 6B partially show, in top and side views, respectively, a possible shape for the spider elastic arm. In these figures, the same reference numbers used in FIGS. 1 and 2 are maintained, except for the spider elastic arm which in this particular case, is provided with a central finger 16A and two lateral fingers 16B and 16C whose ends are staggered relative to the end of finger 16A. In FIGS. 6A and 6B, reference number 24 denotes the counter armature which is interposed between armature 13 and O-RINGs 20 and 21. At the end where the O-RING 20 acts, the counter armature is less in width to enable armature 13 to be restrained to the ends of fingers 16B and 16C.

What is claimed is:

1. A method of manufacturing an armature group for mosaic printing head in which each one of a plurality of armatures are radially arranged about an axis through said head and is restrained to an end of a different one of a plurality of flat elastic arms radially protruding from a spring steel flat annular element, said method comprising the steps of:

(a) blanking a magnetic material plate to obtain an intermediate armature group wherein said armatures are in a relatively correct position and joined to one another by means of a plurality of diaphragms;

(b) positioning said flat annular element on said intermediate armature group so that the end of each of said flat elastic arms is in contact with a predetermined zone of a corresponding one of said armatures of said intermediate armature group;

(c) resistance welding the ends of said flat elastic arms on said armatures of said intermediate armature group; and, (d) removing said plurality of diaphragms.

* * * * *